US009604484B2

(12) United States Patent
Noh

(10) Patent No.: US 9,604,484 B2
(45) Date of Patent: Mar. 28, 2017

(54) INTEGRATED CARTRIDGE AND PORTABLE PRINTER USING SAME

(71) Applicant: Prinics Co., Ltd., Suwon-si (KR)

(72) Inventor: Kwang-Ho Noh, Hwaseong-si (KR)

(73) Assignee: PRINICS CO., LTD., Suwon-si (KR)

( * ) Notice: Subject to any disclaimer, the term of this patent is extended or adjusted under 35 U.S.C. 154(b) by 0 days.

(21) Appl. No.: 15/112,423

(22) PCT Filed: Aug. 26, 2014

(86) PCT No.: PCT/KR2014/007936
§ 371 (c)(1),
(2) Date: Jul. 19, 2016

(87) PCT Pub. No.: WO2015/111812
PCT Pub. Date: Jul. 30, 2015

(65) Prior Publication Data

US 2016/0332466 A1 Nov. 17, 2016

(30) Foreign Application Priority Data

Jan. 24, 2014 (KR) ..... 10-2014-0008668

(51) Int. Cl.
*B41J 2/15* (2006.01)
*B41J 32/02* (2006.01)

(52) U.S. Cl.
CPC ..... *B41J 32/02* (2013.01)

(58) Field of Classification Search
CPC . B41J 2/32; B41J 11/04; B41J 2202/31; B41J 29/38; B41J 11/0025; B41J 15/042
See application file for complete search history.

(56) References Cited

U.S. PATENT DOCUMENTS 6,008,830 A * 12/1999 Yamada ..... B41J 2/32 347/171
6,232,993 B1 * 5/2001 Kobayashi ..... B41J 3/4075 347/175

FOREIGN PATENT DOCUMENTS

| | | | |
|---|---|---|---|
| JP | 03-184885 | A | 8/1991 |
| KR | 2019970001091 | Y1 | 2/1997 |
| KR | 2020000015514 | U | 8/2000 |
| KR | 1020080077005 | A | 8/2008 |

* cited by examiner

*Primary Examiner* — Lamson Nguyen
(74) *Attorney, Agent, or Firm* — Goldilocks ZONE IP Law

(57) ABSTRACT

An integrated cartridge and a printer using the same is provided, the integrated cartridge in which an ink ribbon and a printing medium are provided in one integrated cartridge and the cartridge is inserted through the side of the printer such that the convenience of installation and replacement for a user is improved.

20 Claims, 12 Drawing Sheets

INTEGRATED CARTRIDGE AND PORTABLE PRINTER USING SAME

CROSS REFERENCE TO RELATED PATENT APPLICATIONS

This application claims the benefit under 35 U.S.C. Section 371, of PCT International Application No. PCT/KR2014/007936, filed Aug. 26, 2014, which claimed priority to Korean Patent Application No. 10-2014-0008668,filed Jan. 24, 2014, the disclosures of which are hereby incorporated by the references.

TECHNICAL FIELD

The present invention relates to an integrated cartridge and a printer using the same, and more particularly, to an integrated cartridge and a printer using the integrated cartridge in which an ink ribbon and a printing medium are provided in one integrated cartridge and the cartridge is inserted through the side of the printer, thereby improving convenience in installation and replacement.

BACKGROUND ART

As is generally known, a thermal transfer type printer applies heat to a thermal transfer ribbon on which dye is applied so that the dye applied on the thermal transfer ribbon is transferred to a recording medium to be settled on the recording medium.

According to thermal transfer methods of dye, such a thermal transfer type printer adopts a sublimation type thermal transfer method that dye is transferred while sublimating or a molten type thermal transfer method that dye is transferred while melting by a thermal print head.

FIG. 1 illustrates a conventional thermal transfer type printer. In FIG. 1, the thermal transfer type printer includes: a ribbon cartridge 4 which is detachably mounted inside a housing 2 of the printer; and a cassette 20 which is detachably mounted at one side of the printer and on which many sheets of printout paper are loaded.

The ribbon cartridge 4 is a frame in which an ink ribbon 6 is accommodated. A feed reel 8 for releasing the ink ribbon 6 to feed the ink ribbon while printing and a winding reel 10 for winding and recovering the ink ribbon used are disposed inside the ribbon cartridge 4.

Here, in case of the ink ribbon 6, a three-color dye layer of Yellow Y, Magenta M and Cyan C capable of being activated by heat and an overcoat layer for coating are applied on a substrate of a synthetic resin material in order, and a code for identifying colors by a printer is printed at an edge of the ink ribbon 6.

At an upper end portion of the inside of the cassette 20 on which many sheets of printout paper are loaded, a feeder roller 30 is combined to an upper end of a lever 32, of which the lower end is supported inside a main body, in such a way as to be able to elevate vertically.

Moreover, a capstan 34 capable of rotating by a power source (not shown) is mounted inside the feeder roller 32 to be opposed to a pinch roller 36.

In the meantime, a thermal print head (TPH) 38 is fixed and mounted at an upper portion inside the capstan 34 and the pinch roller 36.

Below the thermal print head 38, a platen 40 is combined to an upper end of a lift lever 42 supported inside the main body by a shaft in such a way as to be able to elevate vertically.

In such a printer, when a print command is entered, the lever 32 rotates on a hinge of a lower end in the clockwise direction in order to rotate the feeder roller 30 in the clockwise direction so that the feeder roller 30 comes into contact with the printout paper, and then, a sheet of the printout paper loaded on the cassette 20 is transferred between the capstan 34 and the pinch roller 36.

Just before the printout paper goes to an exit 44 arranged at the opposite side of the cassette 20, transfer of the printout paper 12 is stopped. When the transfer of the printout paper 12 is finished, the lift lever 42 rotates to compress the platen 40 to the thermal print head 38 at a proper pressure in a state where the ink ribbon 6 and the printout paper 12 are interposed between the thermal print head 38 and the platen 40. While the capstan 34, the feed reel 8 and the winding reel 10 rotate, the thermal print head 38 generates heat to start printing of Yellow Y.

When the printing of Yellow Y is finished, the platen 40 lowers, and then, the printout paper moves to the left in the drawing. After that, printing of Magenta M, Cyan C and the coating layer proceeds. When printing is finished, the printout paper is discharged out through the exist 44.

Furthermore, Korean Patent Laid-open No. 10-2007-0090760 discloses a printer device which allows a printing medium to be inserted to and ejected from the front surface side and an ink ribbon cartridge to be inserted to and removed from the front side surface.

However, the conventional printer has several disadvantages in that it is inconvenient in use and management because an ink ribbon and printout paper are mounted separately and in that the printer is restricted in arrangement and use because the printout paper is exposed to the outside of a printer housing.

Additionally, the conventional printer has a further disadvantage in that printing does not proceed if the printout paper which is turned over is inserted because printout paper must be inserted sheet by sheet.

In addition, the conventional printer has another disadvantage in that it may cause burn to a user because a thermal print head is mounted at an upper portion of the printer housing and the thermal print head of high heat is exposed out when an upper cover of the printer housing is opened.

DISCLOSURE

Technical Problem

Accordingly, the present invention has been made in an effort to solve the above-mentioned problems occurring in the prior arts, and it is an object of the present invention to provide an integrated cartridge and a printer using the integrated cartridge in which an ink ribbon and a printing medium are provided in one integrated cartridge and the cartridge is inserted through the side of the printer, thereby improving convenience in installation and replacement.

Technical Solution

To achieve the above objects, the present invention provides an integrated cartridge including: a cartridge body part having a recording media receiving part which has a feed roller inserting part in which a plurality of recording media are accommodated and a feed roller is inserted, a recording media outlet for discharging the recording media and a double feed prevention groove mounted above the recording media outlet to block feeding of the recording media so that just one of the recording media doubly fed can be fed, a feed reel mounting groove mounted at one side of the recording media receiving part, and a winding reel mounting groove mounted at one side of the feed reel mounting groove; a feed reel which is mounted on the feed reel mounting groove of the cartridge body part to wind an ink ribbon fed from the feed reel; a winding reel which is mounted on the winding reel mounting groove of the cartridge body part to wind the ink ribbon fed from the feed reel; and a cartridge covering part which is mounted above the cartridge body part to cover the recording media receiving part, the feed reel mounting groove and the winding reel mounting groove, wherein the recording media receiving part, the feed reel and the winding reel are arranged parallel in a horizontal direction.

Moreover, a thickness of the recording media outlet and a thickness of the double feed prevention groove are larger than a thickness of one sheet of the recording medium.

Furthermore, the cartridge body part includes one or more bosses which protrude inwardly to a predetermined length and are geared with the printer body so as to prevent the cartridge from moving inside the printer.

Additionally, the cartridge body part includes a cartridge fixing hole which is forcedly fit when the cartridge is inserted into the printer, in order to prevent the cartridge from being separated from the printer.

In addition, the cartridge body part includes a hand-grip formed at the side thereof to allow a user to grasp the cartridge with the hand.

Moreover, the integrated cartridge further includes: a dummy paper pressing spring which is mounted on the cartridge body part to press the recording media; and a dummy paper mounted between the dummy paper pressing spring and the recording media.

Furthermore, in another aspect of the present invention, the present invention provides a portable printer including: a cartridge having a recording media receiving part in which a plurality of recording media are accommodated and which feeds the accommodated recording media in order, a feed reel on which an ink ribbon is wound and a winding reel on which the printed ink ribbon will be wound, the feed reel and the winding reel being arranged parallel in a horizontal direction and being formed integrally with each other; and a printer having a cartridge insertion hole which is formed in the side thereof so that the cartridge is inserted from the side.

Additionally, the recording media receiving part includes a recording media outlet for discharging the recording media, and a double feed prevention groove mounted above the recording media outlet to block feeding of the recording media so that just one of the recording media doubly fed can be fed, and a thickness of the recording media outlet and a thickness of the double feed prevention groove are larger than a thickness of one sheet of the recording medium.

In addition, the cartridge includes: one or more bosses geared with the printer to prevent the cartridge inserted into the printer from moving; a cartridge fixing hole which is forcedly fit when the cartridge is inserted into the printer, in order to prevent the cartridge from being separated from the printer; and a hand-grip for allowing the user to grasp the cartridge with the hand.

Moreover, the printer includes: a printer body part which has a receiving space formed therein and a rectangular cartridge insertion hole formed in one side along the lengthwise direction; and a side cover which is mounted on the side of the printer body part to open and close the cartridge insertion hole.

Additionally, the printer body part includes one or more bushings which are geared and combined with the cartridge inserted into the cartridge insertion hole in order to prevent the cartridge from moving inside the printer.

In addition, the printer body part includes a cartridge fixing protrusion which is forcedly fit to the cartridge inserted into the cartridge insertion hole in order to prevent the cartridge from being separated from the printer.

Further, the cartridge further includes: a dummy paper pressing spring which is located above the recording media receiving part to press the recording media; and a dummy paper mounted between the dummy paper pressing spring and the recording media.

Advantageous Effects

As described above, the integrated cartridge and a printer using the same according to the preferred embodiment of the present invention can improve convenience in installation and replacement because the ink ribbon and the printing medium are provided in one integrated cartridge and the cartridge is inserted through the side of the printer.

Moreover, the present invention can prevent exposure of the thermal print head because the cartridge is inserted and mounted from the side of the printer.

Furthermore, the present invention can enhance the design of the printer because it does not need additional door structure for opening and closing the upper part of the printer.

Additionally, the present invention can reduce manufacturing costs and manufacturing processes by improving the structure of the cartridge so as to press the recording media without any pressure device inside the cartridge.

In addition, the present invention can accurately fix the cartridge inside the printer using a plurality of bosses, bushings and fixing protrusions for position correction.

Further, the present invention allows the user to easily pull out the cartridge inserted into the printer because a hand-grip is mounted on the cartridge.

MODE FOR INVENTION

Hereinafter, reference will be now made in detail to the preferred embodiment of the present invention with reference to the attached drawings.

Cartridge

Figure 1:
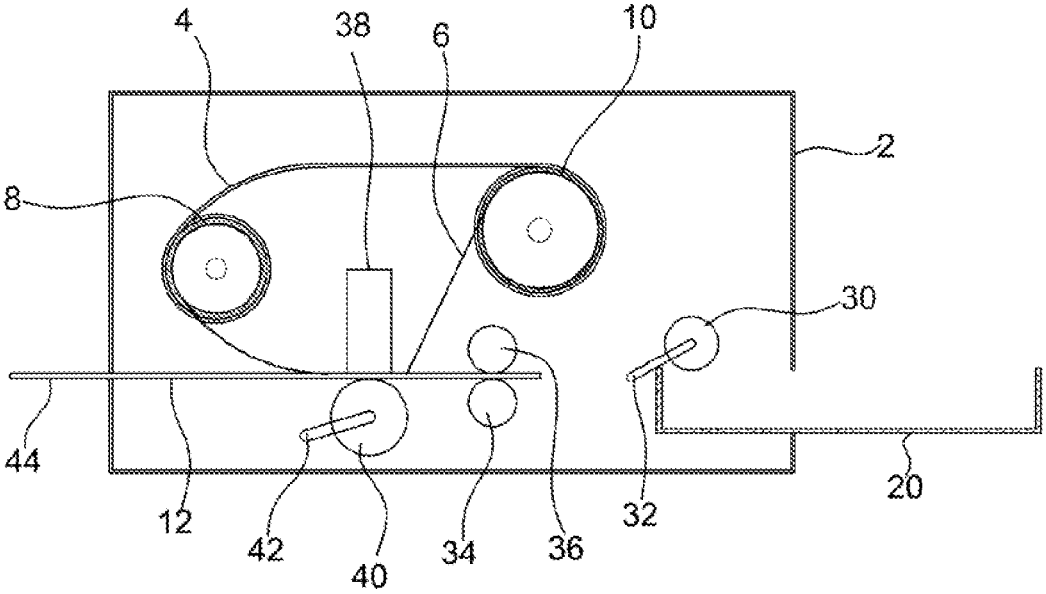
FIG. 1 is a sectional view showing a structure of a printer according to a prior art.
Figure 2:
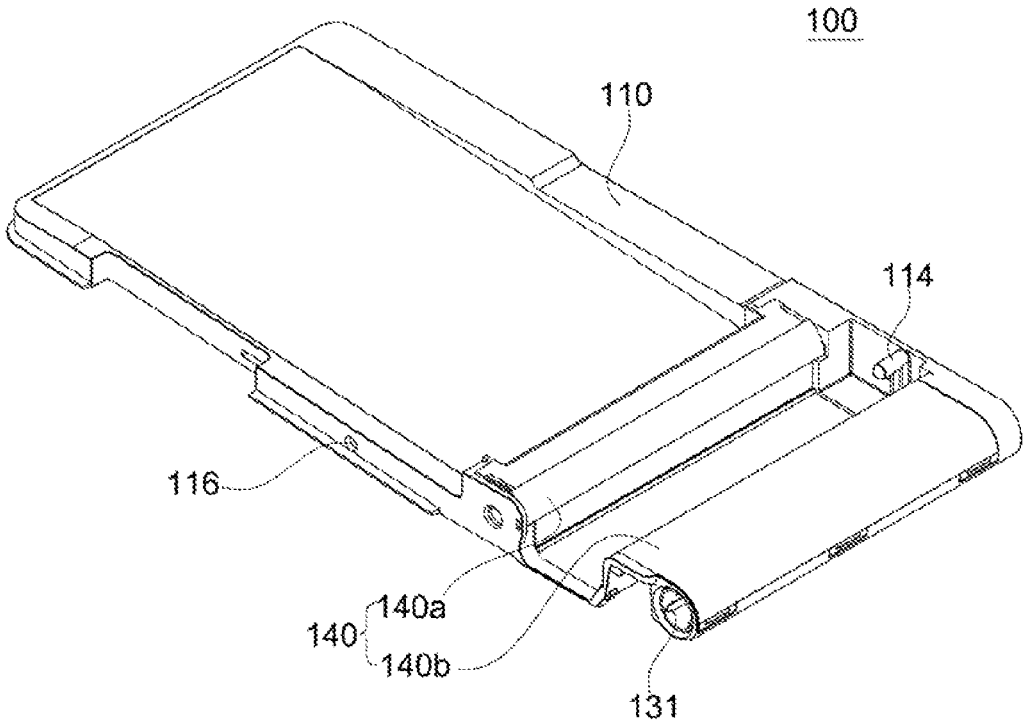
FIG. 2 is a perspective view of the right side, showing an integrated cartridge according to a preferred embodiment of the present invention.
Figure 3:
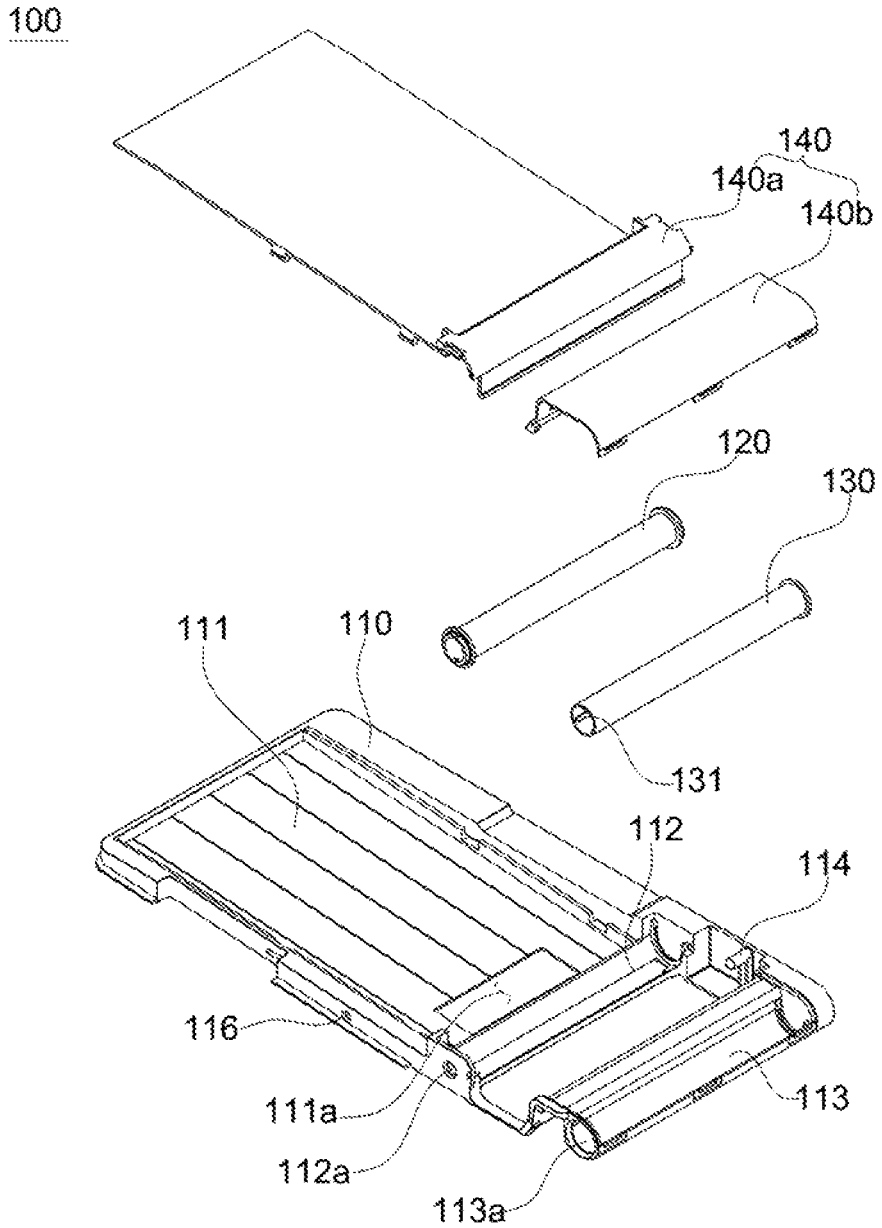
FIG. 3 is an exploded perspective view showing a structure of the integrated cartridge of FIG. 2.
Figure 4:
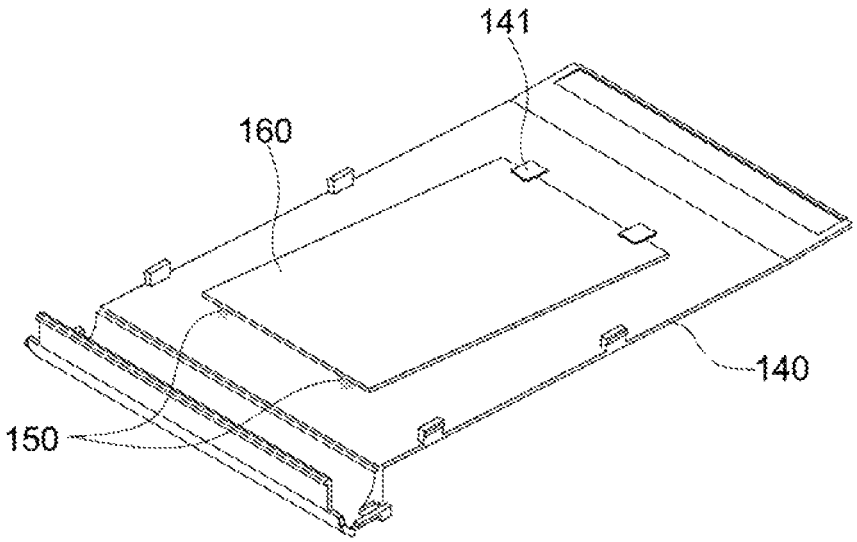
FIG. 4 is a perspective view showing the bottom side of a cover part of the integrated cartridge of FIG. 2.
Figure 5:
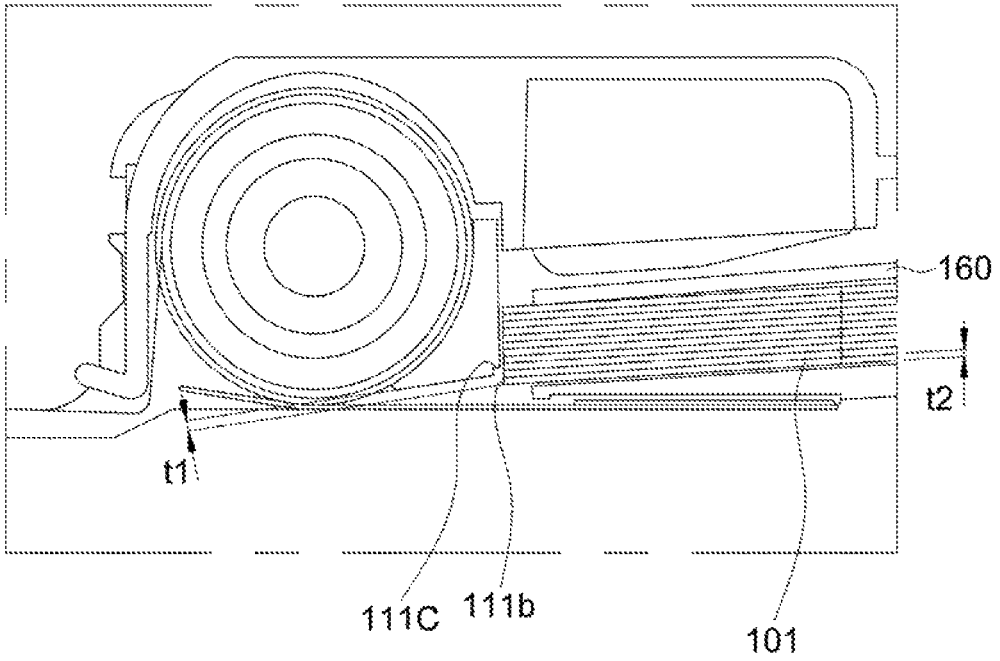
FIG. 5 is a sectional view showing a structure of a recording media outlet of the integrated cartridge of FIG. 2.
Figure 6:
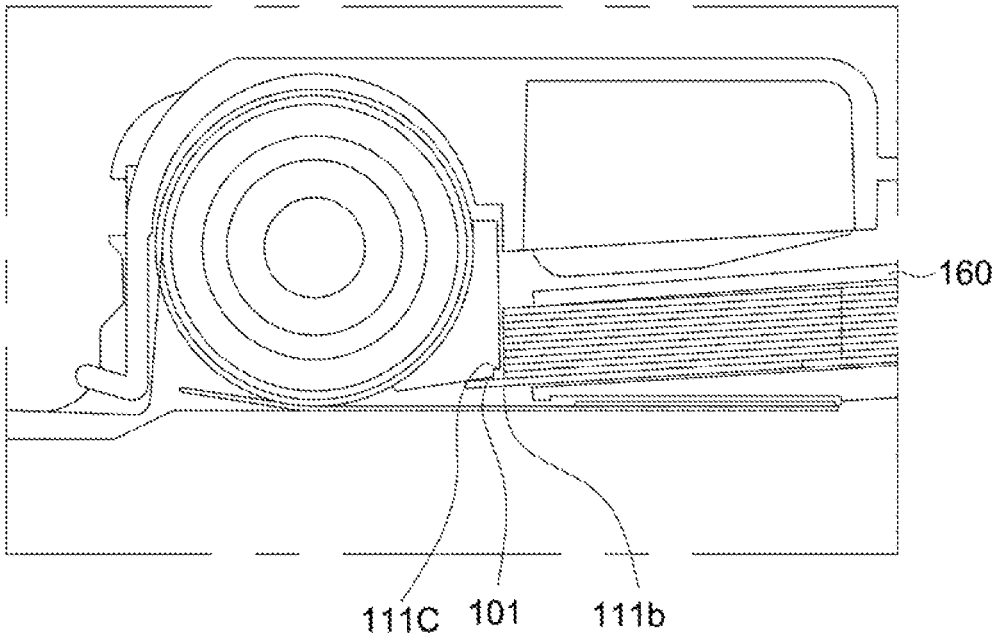
FIG. 6 is an exemplary view showing a process that a recording medium of the integrated cartridge of FIG. 2 is fed normally.
Figure 7:
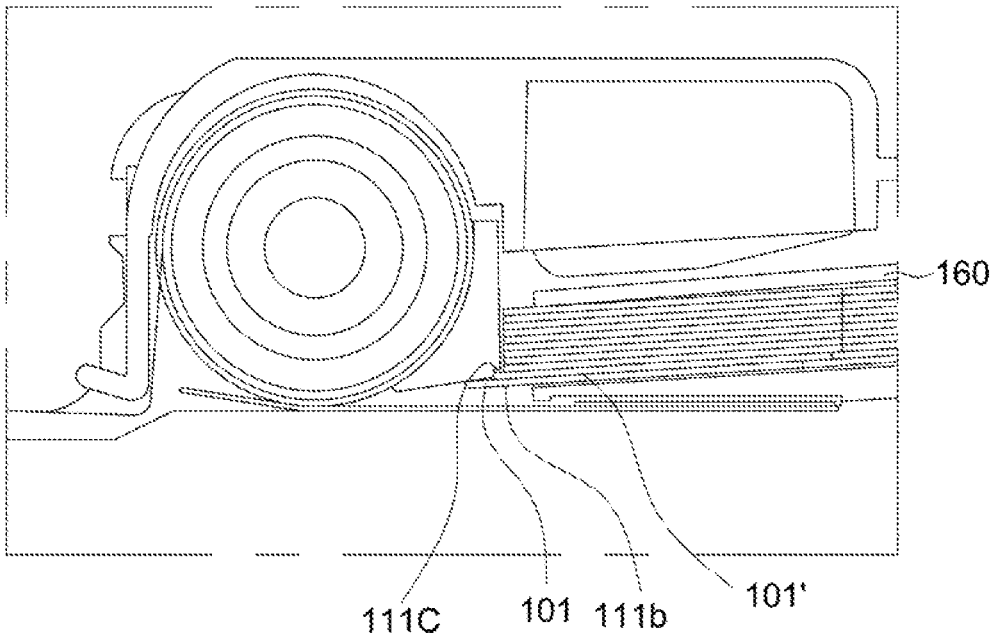
FIG. 7 is another exemplary view showing a process that the recording media of the integrated cartridge of FIG. 2 are fed doubly.
Figure 8:
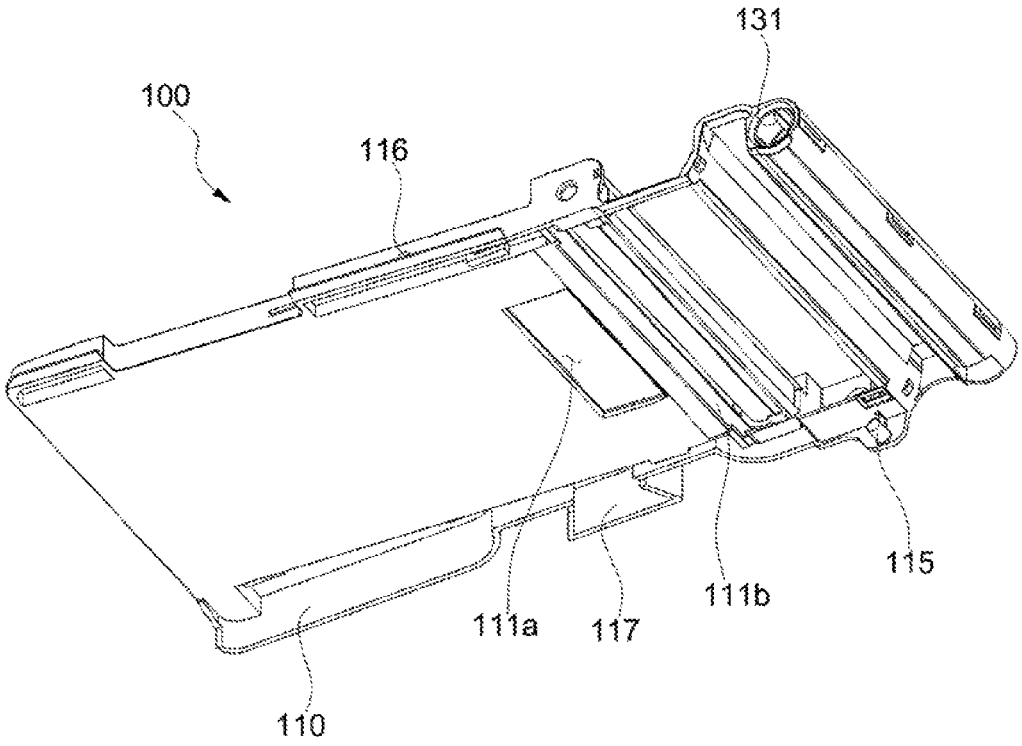
FIG. 8 is a perspective view of the right bottom, showing the integrated cartridge of FIG. 2.
Figure 9:
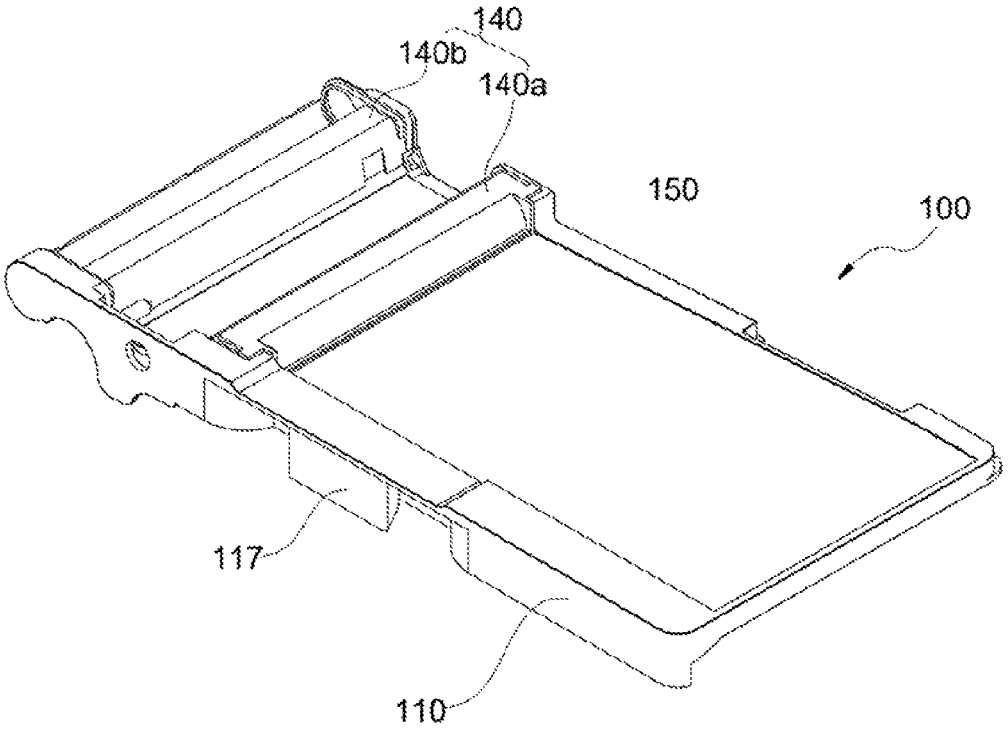
FIG. 9 is a perspective view of the left side, showing the integrated cartridge of FIG. 2.

FIG. 2 is a perspective view of the right side, showing an integrated cartridge according to a preferred embodiment of the present invention, FIG. 3 is an exploded perspective view showing a structure of the integrated cartridge of FIG. 2, FIG. 4 is a perspective view showing the bottom side of a cover part of the integrated cartridge of FIG. 2, FIG. 5 is a sectional view showing a structure of a recording media outlet of the integrated cartridge of FIG. 2, FIG. 6 is an exemplary view showing a process that a recording medium of the integrated cartridge of FIG. 2 is fed normally, FIG. 7 is another exemplary view showing a process that the recording media of the integrated cartridge of FIG. 2 are fed doubly, FIG. 8 is a perspective view of the right bottom, showing the integrated cartridge of FIG. 2, and FIG. 9 is a perspective view of the left side, showing the integrated cartridge of FIG. 2.

As shown in FIGS. 2 to 9, the integrated cartridge 100 according to the preferred embodiment of the present invention includes: a body part 110 having a recording media receiving part 111 for receiving recording media; a feed reel 120 on which an ink ribbon is wound; a winding reel 130 on which the printed ink ribbon is wound, the feed reel 120 and the winding reel 130 being arranged in a row and formed integrally; a cartridge covering part 140; a dummy paper pressing spring 150; and a dummy paper 160.

The cartridge body part 110 has the recording media receiving part 111 which is mounted at one side and has a receiving space for receiving recording media 101. A feed reel mounting groove 111 is mounted at one side of the recording media receiving part 111, and the feed reel 120 is mounted in the feed reel mounting groove 112. A winding reel mounting groove 113 for mounting the winding reel 130 is formed at one side which is spaced apart from the feed reel mounting groove at a predetermined interval.

Moreover, the cartridge body part 110 includes a first boss 114 and a second boss 115 mounted between the feed reel mounting groove 112 and the winding reel mounting groove 113 and a cartridge fixing hole 116 and a hand-grip 117 mounted on the side surface of the cartridge body part 110.

The recording media receiving part 111 is formed to be inclined to one side so that the embedded recording medium 101 can be easily moved in the direction of the feed reel mounting groove 112. A feeder roller inserting part 111*a* is bored in the bottom surface of the recording media receiving part 111 to allow insertion of a feeder roller (not shown), and a recording media outlet 111*b* bored in a rectangular shape in the recording media receiving part 111 so that the embedded recording medium 101 can be discharged out through the recording media outlet 111*b* by operation of the feed roller.

The recording media outlet 111*b* has a double feed prevention groove 111*c* mounted above the recording media outlet 111*b* to prevent feeding of the recording media 101 so that just one of the recording media 101 doubly fed from the recording media receiving part 111 is fed. Thicknesses (t1) of the recording media outlet 111*b* and the double feed prevention groove 111*c* are larger than a thickness (t2) of one sheet of the recording medium 101.

That is, if the recording media 101 are normally fed through the recording media outlet 111*b*, as shown in FIG. 6, the recording media 101 are fed sheet by sheet. However, if another recording medium 101' loaded on the target recording medium 101 to be fed is fed doubly due to friction force, even though the recording media 101 and 101' are fed doubly as shown in FIG. 7, feeding of the recording medium 101' is blocked by the double feed prevention groove 111*c* so that just one sheet of the recording medium 101 is fed through the recording media outlet 111*b*.

The feed reel mounting groove 112 has a feed reel hole 112*a* bored at one side, and an upper part of the feed reel mounting groove 112 is opened. The feed reel 120 is seated on the feed reel mounting groove 112 to be able to rotate.

The winding reel mounting groove 113 has a winding reel hole 113*a* bored at one side, and an upper part of the winding reel mounting groove 113 is opened. The winding reel 130 is seated on the winding reel mounting groove 113 to be able to rotate.

The first boss 114 is a member protruding to a predetermined length toward the inside the cartridge body part 110, and is geared with the bushing formed on the printer body.

The second boss 115 is spaced apart from a lower part of the first boss 114 at a predetermined interval and protrudes to a predetermined length toward the inside the cartridge body part 110. The second boss 115 is combined with the bushing formed on the printer body so as to firmly support the cartridge 100 inside the printer together with the first boss 114.

In this embodiment, the two bosses 114 and 115 are mounted to prevent the cartridge body part 110 from moving during printing, but the present invention is not limited to the above but may be changed in various ways, for instance, has one boss and a retaining protrusion having a stepped jaw.

The cartridge fixing hole 116 is bored in one side surface of the cartridge body part 110. When the cartridge 100 is inserted into the printer, the cartridge fixing hole 116 is forcedly fit to a cartridge fixing protrusion formed on the printer so that the cartridge 100 is fixed at a predetermined position of the printer, and prevents the cartridge 100 inserted into the printer from being separated from the printer.

The hand-grip 117 is mounted on the side of the cartridge body part 110 in order to allow a user to grasp the cartridge 100 with the hand, so that the user can easily pull out the cartridge 100 inserted into the side of the printer.

The feed reel 120 is mounted on the feed reel mounting groove 112, so that the ink ribbon wound on the feed reel is fed at the time of printing.

The winding reel 130 is mounted on the winding reel mounting groove 113, so that the ink ribbon fed from the feed reel 120 is wound on the winding reel, and has a joining protrusion 131 mounted at one side to be geared with a felt slip driving part (not shown) mounted on the printer.

The cartridge covering part 140 is mounted on the cartridge body part 110 to cover and protect the recording media receiving part 111, the feed reel mounting groove 112 and the winding reel mounting groove 113. The cartridge covering part 140 includes: a first cartridge cover 140*a* for covering the upper parts of the recording media receiving part 111 and the feed reel mounting groove 112; a second cartridge cover 140*b* for covering the upper art of the winding reel mounting groove 113; and paper fixing members 141 for fixing the dummy paper 160.

The dummy paper pressing spring 150 is mounted on the cartridge body part 110 to press the recording media 101 so that the recording media 101 can come into close contact with the feeder roller (not shown).

The dummy paper 160 is put between the dummy paper pressing spring 150 and the recording media 101 so that the recording media 101 can be evenly pressed and all of the recording media 101 accommodated in the recording media receiving part 111 can be fed.

Printer

Figure 10:
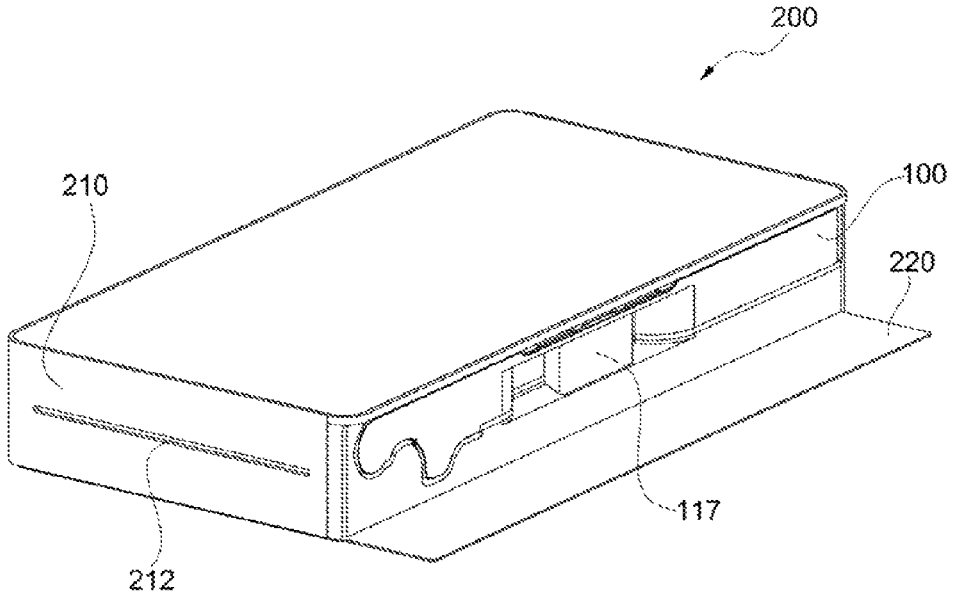
FIG. 10 is a perspective view showing a portable printer using the integrated cartridge according to the preferred embodiment of the present invention.
Figure 11:
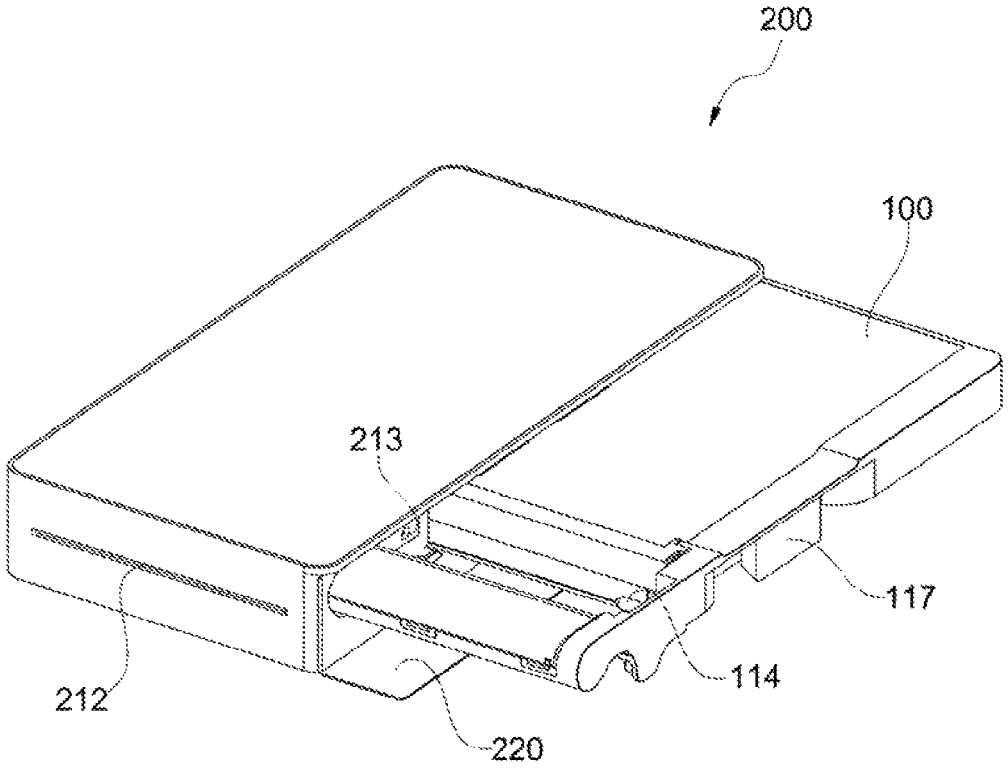
FIG. 11 is a perspective view showing a cartridge insertion process of the portable printer using the integrated cartridge of FIG. 10.
Figure 12:
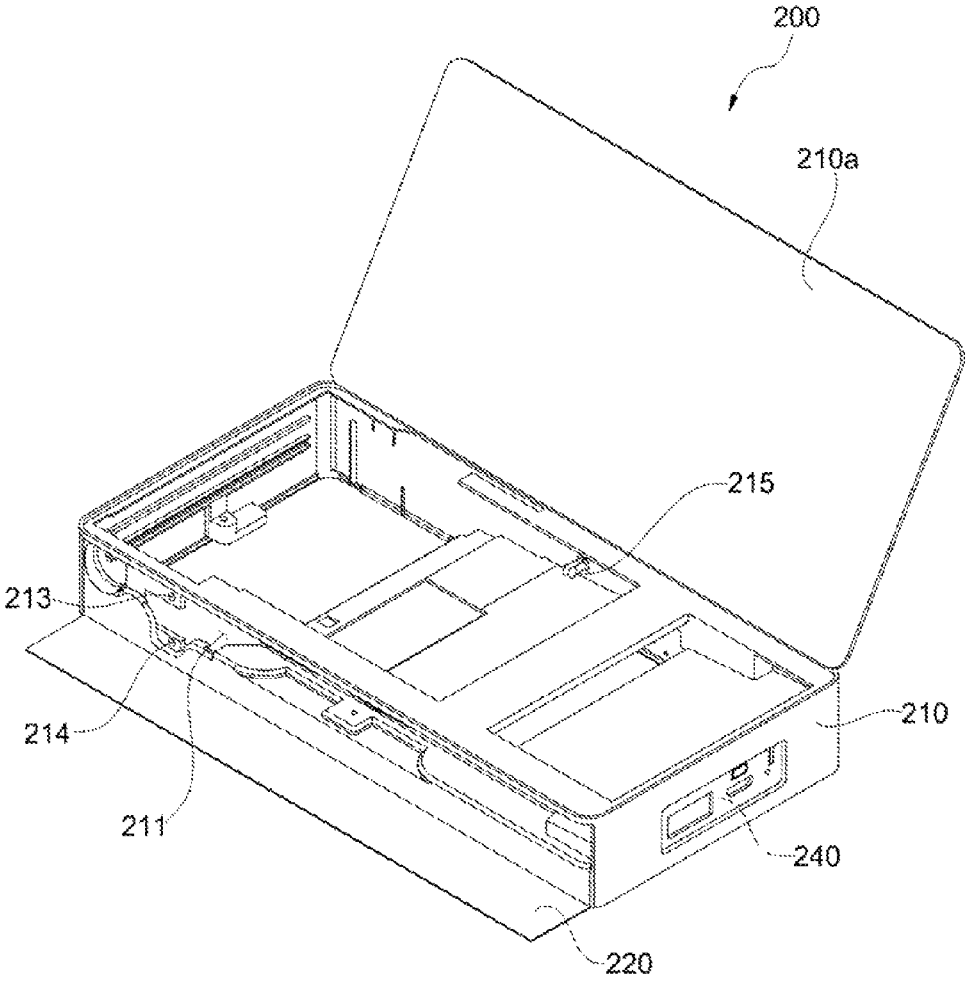
FIG. 12 is a perspective view showing an internal structure of the portable printer using the integrated cartridge of FIG. 10.

FIG. 10 is a perspective view showing a portable printer using the integrated cartridge according to the preferred embodiment of the present invention, FIG. 11 is a perspective view showing a cartridge insertion process of the portable printer using the integrated cartridge of FIG. 10, and FIG. 12 is a perspective view showing an internal structure of the portable printer using the integrated cartridge of FIG. 10.

As shown in FIGS. 2 to 12, the portable printer 200 using the integrated cartridge according to the preferred embodiment of the present invention includes: a cartridge 100 having a recording media receiving part 111 for receiving recording media 101, a feed reel 120 on which an ink ribbon is wound and a winding reel 130 on which the printed ink ribbon will be wound, the feed reel 120 and the winding reel 130 being arranged parallel in a row in a horizontal direction and being formed integrally with each other; and a printer 200 having a cartridge insertion hole 211 which is formed in the side thereof so that the cartridge 100 is inserted from the side.

The cartridge 100 according to the preferred embodiment of the present invention includes: a body part 110 having the recording media receiving part 111 in which recording media 101 are accommodated; the feed reel 120 on which the ink ribbon is wound; the winding reel 130 on which the printed ink ribbon is wound, the feed reel 120 and the winding reel 130 being arranged in a row and formed integrally; a cartridge covering part 140; a dummy paper pressing spring 150; and a dummy paper 160. The dummy paper pressing spring 150 and the dummy paper 160 are put on the recording media receiving part 111 so that the cartridge covering part 140 can press the recording media 101 accommodated in the recording media receiving part 111.

The recording media receiving part 111 is formed to be inclined to one side so that the embedded recording medium 101 can be easily moved in the direction of the feed reel mounting groove 112. A feeder roller inserting part 111*a* is bored in the bottom surface of the recording media receiving part 111 to allow insertion of a feeder roller (not shown), and a recording media outlet 111*b* bored in a rectangular shape in the recording media receiving part 111 so that the embedded recording medium 101 can be discharged out through the recording media outlet 111*b* by operation of the feed roller.

The recording media outlet 111*b* has a double feed prevention groove 111*c* mounted above the recording media outlet 111*b* to prevent feeding of the recording media 101 so that just one of the recording media 101 doubly fed from the recording media receiving part 111 is fed. A thickness (t1) of the recording media outlet 111*b* and the double feed prevention groove 111*c* is larger than a thickness (t2) of one sheet of the recording medium 101.

Moreover, the cartridge 100 includes a first boss 114 and a second boss 115 which are mounted on the cartridge body part 110 and are geared with the printer 200 to prevent that the cartridge 100 inserted into the printer 200 moves during printing.

Furthermore, the cartridge 100 has a cartridge fixing hole 116 which is formed at one side to be forcedly fit to a cartridge fixing protrusion 215 mounted on the printer 200 so that the cartridge 100 is fixed at a predetermined position of the printer and the cartridge 100 inserted into the printer 200 is prevented from being separated from the printer 200.

Additionally, the cartridge 100 has a hand-grip 117 mounted on the side of the cartridge body part 110 to allow the user to grasp the cartridge 100 with the hand, so that the user can grasp the cartridge 100 and easily pull out the cartridge 100 from the printer 200.

The printer 200 includes: a rectangular printer body part 210 having a cartridge insertion hole 211 formed at the side to allow insertion of the cartridge 100; and a side cover 220.

The printer body part 210 includes: a receiving space formed therein; the cartridge insertion hole 211 formed at the side to allow insertion of the cartridge 100; an outlet 212 through which the recording medium is pulled out; and a first bushing 213, a second bushing 214 and a cartridge fixing protrusion 215 combined with the cartridge 100.

The cartridge insertion hole 211 is a rectangular through hole formed along the lengthwise side of the printer body part 210, preferably, has the same shape as the lengthwise cross section of the cartridge 100.

The first bushing 213 and the second bushing 214 are formed an end of a "⊂"-shaped frame inside the printer body part 210 and are respectively combined with the first boss 114 and the second boss 115 of the cartridge 100 so that the cartridge 100 is fixed at the predetermined position of the printer 200 not to move during printing.

The cartridge fixing protrusion 215 is a wedge-shaped member protruding to a predetermined length from the inner face of the printer body part 210 and is forcedly fit to the cartridge fixing hole 116 of the cartridge 100 inserted into the cartridge insertion hole 211 so as to guide the cartridge 100 to be arranged at the predetermined position of the printer 200 and prevent the cartridge 100 from being separated from the printer 200.

The side cover 220 is rotatably mounted at the side of the printer body part 210 so that the cartridge insertion hole 211 is selectively opened and closed.

Therefore, the integrated cartridge and a printer using the same according to the preferred embodiment of the present invention can improve convenience in installation and replacement because the ink ribbon and the printing medium are provided in one integrated cartridge and the cartridge is inserted through the side of the printer. Moreover, the present invention can prevent exposure of the thermal print head because the cartridge is inserted and mounted from the side of the printer, thereby reducing an occurrence rate of the user's burn. Furthermore, the present invention can reduce manufacturing costs and manufacturing processes by improving the structure of the cartridge so as to press the recording media without any pressure device inside the cartridge. Additionally, the present invention can accurately fix the cartridge inside the printer using a plurality of bosses, bushings and fixing protrusions for position correction and allow the user to easily pull out the cartridge from the printer through hand-grip.

While the present invention has been particularly shown and described with reference to exemplary embodiments thereof, it will be understood by those of ordinary skill in the art that various changes and modifications in form and details may be made therein without departing from the spirit and scope of the present invention as defined by the following claims.

Furthermore, in the drawings, thicknesses of lines and sizes of components may be exaggerated for clarity and convenience in explanation. In addition, the terms of the components used in the present invention are defined in consideration of the functions of the present invention, and may differ depending on the intentions of a user or an operator or custom. Accordingly, such wordings should be defined on the basis of the contents of the overall specification.

What is claimed is:

1. An integrated cartridge comprising:

a cartridge body part having a recording media receiving part which has a feed roller inserting part in which a plurality of recording media are accommodated and a feed roller is inserted, a recording media outlet for discharging the recording media and a double feed prevention groove mounted above the recording media outlet to block feeding of the recording media so that just one of the recording media doubly fed can be fed, a feed reel mounting groove mounted at one side of the recording media receiving part, and a winding reel mounting groove mounted at one side of the feed reel mounting groove;

a feed reel which is mounted on the feed reel mounting groove of the cartridge body part to wind an ink ribbon fed from the feed reel;

a winding reel which is mounted on the winding reel mounting groove of the cartridge body part to wind the ink ribbon fed from the feed reel; and a cartridge covering part which is mounted above the cartridge body part to cover the recording media receiving part, the feed reel mounting groove and the winding reel mounting groove, wherein the recording media receiving part, the feed reel and the winding reel are arranged parallel in a horizontal direction.

2. The integrated cartridge according to claim 1, wherein a thickness of the recording media outlet and a thickness of the double feed prevention groove are larger than a thickness of one sheet of the recording medium.

3. The integrated cartridge according to claim 2, further comprising:

a dummy paper pressing spring which is mounted on the cartridge body part to press the recording media; and a dummy paper mounted between the dummy paper pressing spring and the recording media.

4. The integrated cartridge according to claim 1, wherein the cartridge body part includes one or more bosses which protrude inwardly to a predetermined length and are geared with the printer body so as to prevent the cartridge from moving inside the printer.

5. The integrated cartridge according to claim 4, further comprising:

a dummy paper pressing spring which is mounted on the cartridge body part to press the recording media; and a dummy paper mounted between the dummy paper pressing spring and the recording media.

6. The integrated cartridge according to claim 1, wherein the cartridge body part includes a cartridge fixing hole which is forcedly fit when the cartridge is inserted into the printer, in order to prevent the cartridge from being separated from the printer.

7. The integrated cartridge according to claim 6, further comprising:

a dummy paper pressing spring which is mounted on the cartridge body part to press the recording media; and a dummy paper mounted between the dummy paper pressing spring and the recording media.

8. The integrated cartridge according to claim 1, wherein the cartridge body part includes a hand-grip formed at the side thereof to allow a user to grasp the cartridge with the hand.

9. The integrated cartridge according to claim 8, further comprising:

a dummy paper pressing spring which is mounted on the cartridge body part to press the recording media; and a dummy paper mounted between the dummy paper pressing spring and the recording media.

10. The integrated cartridge according to claims 1, further comprising:

a dummy paper pressing spring which is mounted on the cartridge body part to press the recording media; and a dummy paper mounted between the dummy paper pressing spring and the recording media.

11. A portable printer using an integrated cartridge comprising:

a cartridge having a recording media receiving part which a plurality of recording media are accommodated and which feeds the accommodated recording media in order, a feed reel on which an ink ribbon is wound and a winding reel on which the printed ink ribbon will be wound, the feed reel and the winding reel being arranged parallel in a horizontal direction and being formed integrally with each other; and a printer having a cartridge insertion hole which is formed in the side thereof so that the cartridge is inserted from the side.

12. The portable printer according to claim 11, wherein the recording media receiving part includes a recording media outlet for discharging the recording media, and a double feed prevention groove mounted above the recording media outlet to block feeding of the recording media so that just one of the recording media doubly fed can be fed, and wherein a thickness of the recording media outlet and a thickness of the double feed prevention groove are larger than a thickness of one sheet of the recording medium.

13. The portable printer according to claim 12, wherein the cartridge further includes:

a dummy paper pressing spring which is located above the recording media receiving part to press the recording media; and a dummy paper mounted between the dummy paper pressing spring and the recording media.

14. The portable printer according to claim 11, wherein the cartridge includes: one or more bosses geared with the printer to prevent the cartridge inserted into the printer from moving; a cartridge fixing hole which is forcedly fit when the cartridge is inserted into the printer, in order to prevent the cartridge from being separated from the printer; and a hand-grip for allowing the user to grasp the cartridge with the hand.

15. The portable printer according to claim 14, wherein the cartridge further includes:

a dummy paper pressing spring which is located above the recording media receiving part to press the recording media; and a dummy paper mounted between the dummy paper pressing spring and the recording media.

16. The portable printer according to claim 11, wherein the printer includes:

a printer body part which has a receiving space formed therein and a rectangular cartridge insertion hole formed in one side along the lengthwise direction; and a side cover which is mounted on the side of the printer body part to open and close the cartridge insertion hole.

17. The portable printer according to claim 16, wherein the printer body part includes one or more bushings which are geared and combined with the cartridge inserted into the cartridge insertion hole in order to prevent the cartridge from moving inside the printer.

18. The portable printer according to claim 16, wherein the printer body part includes a cartridge fixing protrusion which is forcedly fit to the cartridge inserted into the cartridge insertion hole in order to prevent the cartridge from being separated from the printer.

19. The portable printer according to claim 16, wherein the cartridge further includes:

a dummy paper pressing spring which is located above the recording media receiving part to press the recording media; and a dummy paper mounted between the dummy paper pressing spring and the recording media.

20. The portable printer according to claim 11, wherein the cartridge further includes:

a dummy paper pressing spring which is located above the recording media receiving part to press the recording media; and a dummy paper mounted between the dummy paper pressing spring and the recording media.

* * * * *